US008152005B2

(12) United States Patent
Barkdoll et al.

(10) Patent No.: US 8,152,005 B2
(45) Date of Patent: Apr. 10, 2012

(54) OVER WIRE HOOK LATCHING BIN OR TRAY

(75) Inventors: Patrick J. Barkdoll, Pecatonica, IL (US); Thomas E. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 690 days.

(21) Appl. No.: 12/195,464

(22) Filed: Aug. 21, 2008

(65) Prior Publication Data

US 2010/0044328 A1 Feb. 25, 2010

(51) Int. Cl.
*A47F 5/08* (2006.01)

(52) U.S. Cl. ..... 211/88.01; 248/214

(58) Field of Classification Search ..... 211/88.01, 211/88.03, 106.01, 106, 86.01, 133.3, 184, 211/43, 59.1, 87.01; 206/561; 220/482, 220/476; 248/214, 215, 340, 229.16, 229.26
See application file for complete search history.

(56) References Cited

U.S. PATENT DOCUMENTS

| | | | | | |
|---|---|---|---|---|---|
| 1,149,541 | A | * | 8/1915 | Rees | 297/188.05 |
| 2,831,598 | A | * | 4/1958 | Slavsky et al. | 220/482 |
| 3,112,143 | A | * | 11/1963 | Benjamin et al. | 312/140.3 |
| 3,325,038 | A | * | 6/1967 | Ferney | 52/11 |
| 3,659,722 | A | * | 5/1972 | Carroll | 211/106 |
| 3,908,831 | A | * | 9/1975 | Brendgord | 211/88.01 |
| 4,552,272 | A | * | 11/1985 | Field | 211/88.01 |
| 4,724,967 | A | * | 2/1988 | Valiulis | 211/59.1 |
| 4,759,449 | A | * | 7/1988 | Gold | 211/43 |
| 4,858,867 | A | * | 8/1989 | King | 248/214 |
| 5,588,543 | A | * | 12/1996 | Finger | 211/90.01 |
| 5,727,696 | A | | 3/1998 | Valiulis | |
| 5,887,731 | A | * | 3/1999 | Thalenfeld | 211/57.1 |
| 6,726,035 | B2 | | 4/2004 | Zadak | |
| 6,758,355 | B2 | * | 7/2004 | Zidek | 211/205 |
| 2006/0180561 | A1 | * | 8/2006 | Wisnoski et al. | 211/94.01 |

OTHER PUBLICATIONS

U.S. Appl. No. 29/323,221, filed Aug. 21, 2008, Barkdoll et al.
U.S. Appl. No. 29/323,225, filed Aug. 21, 2008, Barkdoll et al.
Southern Imperial, Inc., Dump Bins RPDMP-127032 @ Southern Imperial, 2 pages, pages from a website, date last visited Jun. 17, 2008, http://shop.southernimperial.com/Dump_Bins_RPDMP-127032_P7765C77.cfm.
Southern Imperial, Inc., Dump Bins RPDMP-129555 @ Southern Imperial, 2 pages, pages from a website, date last visited Jun. 17, 2008, http://shop.southernimperial.com/Dump_Bins_RPDMP-129555_P7764C77.cfm.
Southern Imperial, Inc., Dump Bins RPDMP-65595 @ Southern Imperial, 2 pages, pages from a website, date last visited Jun. 17, 2008, http://shop.southernimperial.com/Dump_Bins_RPDMP-65595_P1934C77.cfm.

(Continued)

*Primary Examiner* — Darnell Jayne
*Assistant Examiner* — Stanton L Krycinski
(74) *Attorney, Agent, or Firm* — Reinhart Boerner Van Deuren P.C.

(57) ABSTRACT

A plastic molded bin that may universally mount to either of cross wires or cross bars in a retail merchandising environment as shown. The bin includes a receptacle and has hooks and retainers projecting from the back wall of the receptacle to provide for the universal mount structure. Partition walls with a mounting structure can be used to divide the merchandise holding chamber into different merchandising compartments.

7 Claims, 6 Drawing Sheets

OTHER PUBLICATIONS

Southern Imperial, Inc., Baskets R40BSKE2410K @ Southern Imperial, 2 pages, pages from a website, date last visited Jun. 17, 2008, http://shop.southernimperial.com/Baskets__R40BSKE2410K__P1345C69.cfm.

Southern Imperial, Inc., Baskets R40-1728-A @ Southern Imperial, 2 pages, pages from a website, date last visited Jun. 17, 2008, http://shop.southernimperial.com/ Baskets__R40-1728-A__P1343C69.cfm.

Southern Imperial, Inc., Wire Endcap Fastracks Displays R40-III-1BX @ Southern Imperial , 2 pages, pages from a website, date last visited Jun. 17, 2008, http://shop.southernimperial.com/Wire__Endcap__Fastracks__Displays__P1632C70.cfm.

Southern Imperial, Inc., Endless Baskets R-9023045 @ Southern Imperial, 2 pages, pages printed from a website, date last visited Jun. 17, 2008, http://shop.southernimperial.com/Endless__Baskets__R-9023045__P1445076.cfm.

Southern Imperial, Inc., Wire Endcap Fastracks Displays R40-Baskets @ Southern Imperial, 2 pages, pages printed from a website, date last visited Jun. 17, 2008, http://shopsouthernimperial .com/Wire__Endcap__Fastracks__Displays__P1614C70.CFM.

Southern Imperial, Inc., Wire Endcap Fastracks Displays R40-Shelf @ Southern Imperial , 2 pages, pages printed from a website, date last visited Jun. 17, 2008, http://shop.southernimperial.com/Wire__Endcap__Fastracks__Displays__P1623C70.cfm.

Southern Imperial, Inc., Wire Endcap Fastracks Displays R40-HC @ Southern Imperial, 2 pages, pages printed from a website, date last visited Jun. 17, 2008. http://shop/southernimperial.com/Wire__Endcap__Fastracks__Displays__P1645C70.cfm.

* cited by examiner

OVER WIRE HOOK LATCHING BIN OR TRAY

FIELD OF THE INVENTION

The present invention generally relates to retail display apparatus for displaying retail merchandise, typically in a retail store environment and more particularly relates to bins, trays or other such forms of receptacles that can be mounted to various types of retail support structures such as wire racks and/or cross wires in a retail display environment.

BACKGROUND OF THE INVENTION

In the field of retail display, display assemblies are mounted on vertical supports for presenting merchandise to customers. Two common forms of vertical supports include wire racks such as the FAST RACK® product available from Southern Imperial and cross bars, both of which are typically mounted on two horizontally spaced vertical beams. The wire racks typically comprise multiple horizontally extending and vertically spaced parallel wires that have about a 3/16th inch diameter and about a 1 inch vertical spacing between adjacent wires; and retail cross bars which may also be vertically spaced and in which each cross bar typically has a vertical span of about 1 inch and a lateral thickness of about 3/16th inches.

Various forms of receptacles such as wire baskets are used with such retail support structures so as to provide a bin or tray for holding retail merchandise for presentment to a consumer. There has always been a desire to increase the amount of display options available to a retailer particularly considering the wide variety of merchandise, and shapes and sizes thereof. The present invention is directed toward such improvements over the current state of the art.

BRIEF SUMMARY OF THE INVENTION

One aspect of the present invention is directed toward an apparatus for displaying retail merchandise including a receptacle having a bottom, a front wall, a back wall and a pair of side walls in which the walls extend upward from the bottom to define a chamber for holding retail merchandise. At least one hook and at least one retainer project from the back wall in vertical spaced relation forming a mounting channel.

According to an embodiment of the present invention, the at least one retainer may be partially horizontally offset from at least one hook with each retainer sandwiched between two hooks one on each lateral side of the retainer. Preferably, each hook and each retainer are unitarily molded with the receptacle and with sufficient offset and lack of overlap, the receptacle can be molded with a 1-pull mold. Also, preferably, at least two separate sets of hooks and retainers are spaced laterally apart. The at least one retainer may include a bottom flange projecting rearwardly from the back wall of the receptacle and an upwardly depending flange projecting from the bottom flange and spaced with/in relation to the back wall so as to provide a snap feature or otherwise a feature to prevent unwanted removal or otherwise more secure attachment.

Another aspect of the present invention is directed toward a plastic receptacle adapted to hold retail merchandise that employs a universal mount that is adapted to universally mount on both of a wire rack and a cross bar. The universal mount mounts the receptacle to the wire rack when used with a wire rack and mounts the receptacle to a cross bar when used with the cross bar. In each instance, the receptacle can first be hooked upon either the cross bar or the wire rack by at least one hook projecting from the receptacle and thereafter the receptacle can be pivoted from this installed position to a mounted position in which the at least one retainer is underneath the cross bar or otherwise one of the wires so as to prevent accidental vertical dislodgment of the receptacle from the wire rack or the cross bar.

A further aspect of the present invention is directed towards a new divider wall which can be used with the receptacle having a first and second rows of at least one aperture formed in the bottom of the receptacle in which each aperture has an entry region and a smaller slot region. At least one divider wall is provided which is adapted to divide the receptacle into different compartments. The divider wall has a base end and front and back ends and first and second locking tabs for engagement with the first and second rows of at least one aperture. Each tab has a head and a neck region with the neck spacing the head from the bottom end. The head can project through the entry region of the apertures formed in the bottom of the receptacle and are thereby insertable and removable from the entry region. The heads are larger then the slot region such that when the neck region is disposed in the slot region, the head mounts to the partition to the bottom wall. Preferably, each row comprises a plurality of apertures extending between side walls of the receptacle. As a result, the divider wall can divide the receptacle into adjustable compartments with the divider wall being selectively mounted in a selected pair of apertures, one from each wall.

Another aspect of the present invention is a method of displaying merchandise in the retail environment using at least one of a wire rack and a cross bar. The method comprises providing a plastic receptacle adapted to hold retail merchandise in which the receptacle has a universal mount adapted to universally mount on both of the wire rack and the cross bar. As a result, one may select either of the wire rack or the cross bar for use with a receptacle and can mount the receptacle to the selected one of the wire rack and the cross bar with the universal mount.

A preferred method of universal mounting according to certain embodiments includes hooking the receptacle in an installed position, pivoting the receptacle from the installed position to a mounted position and retaining the receptacle against vertical displacement when mounted in the mounted position.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 5:
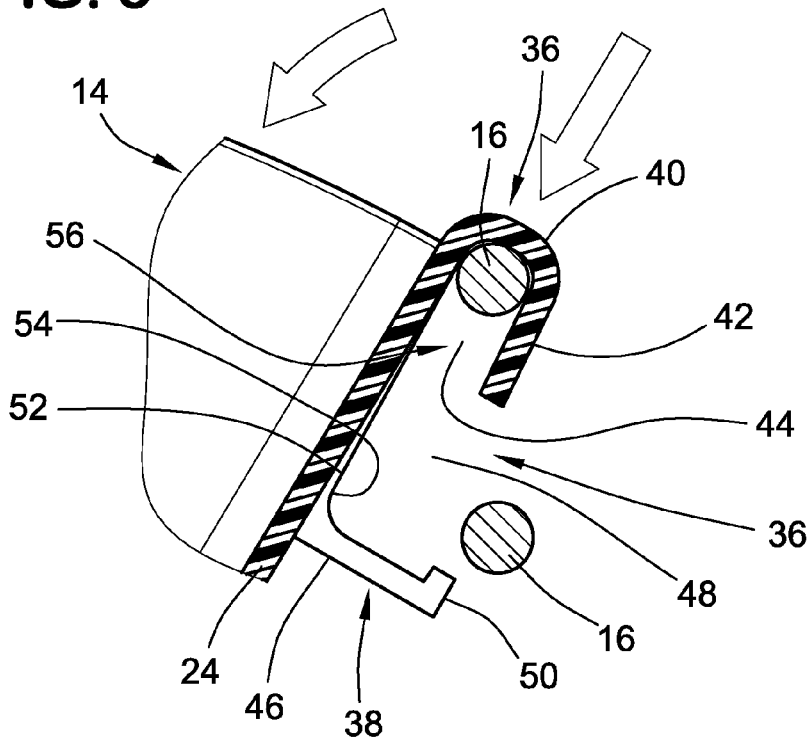
FIGS. 5 and 6 are cross sectional illustrations of the mounting region of the receptacle shown in combination with cross wires which are also shown in cross section, with FIG. 5 showing an installed position and FIG. 6 showing a mounted position which is pivotably displaced from the installed position.
Figure 6:
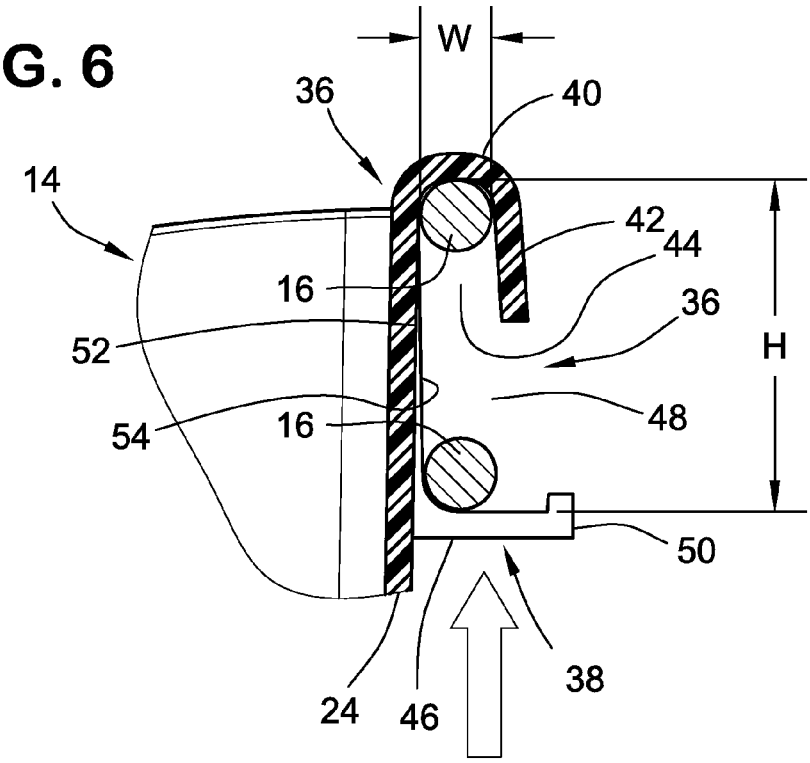
Figure 7:
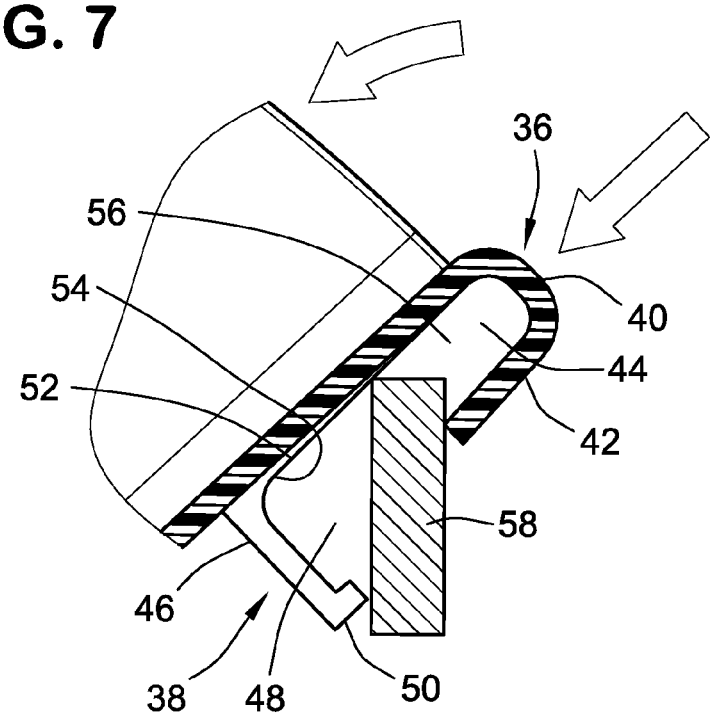
Figure 8:
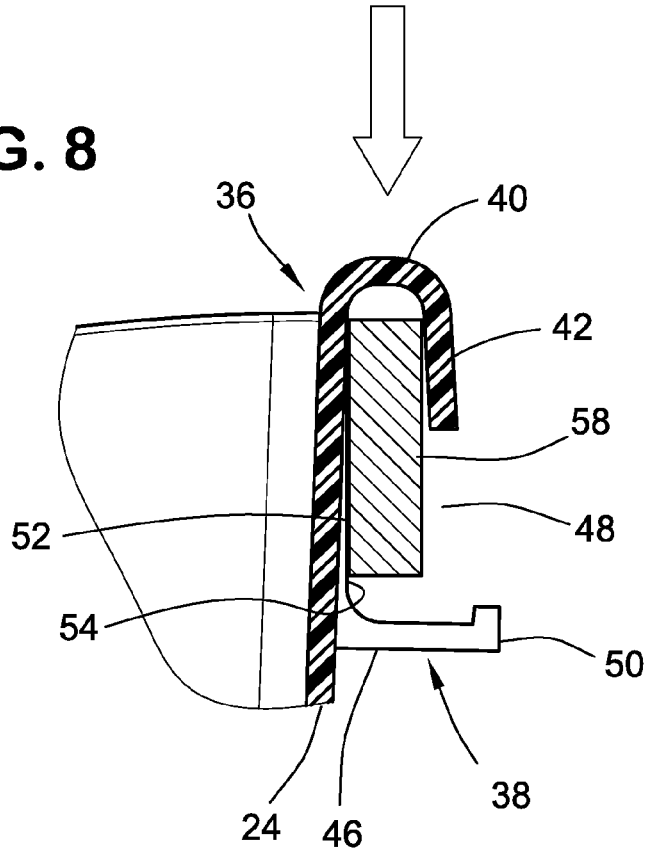
Figure 10:
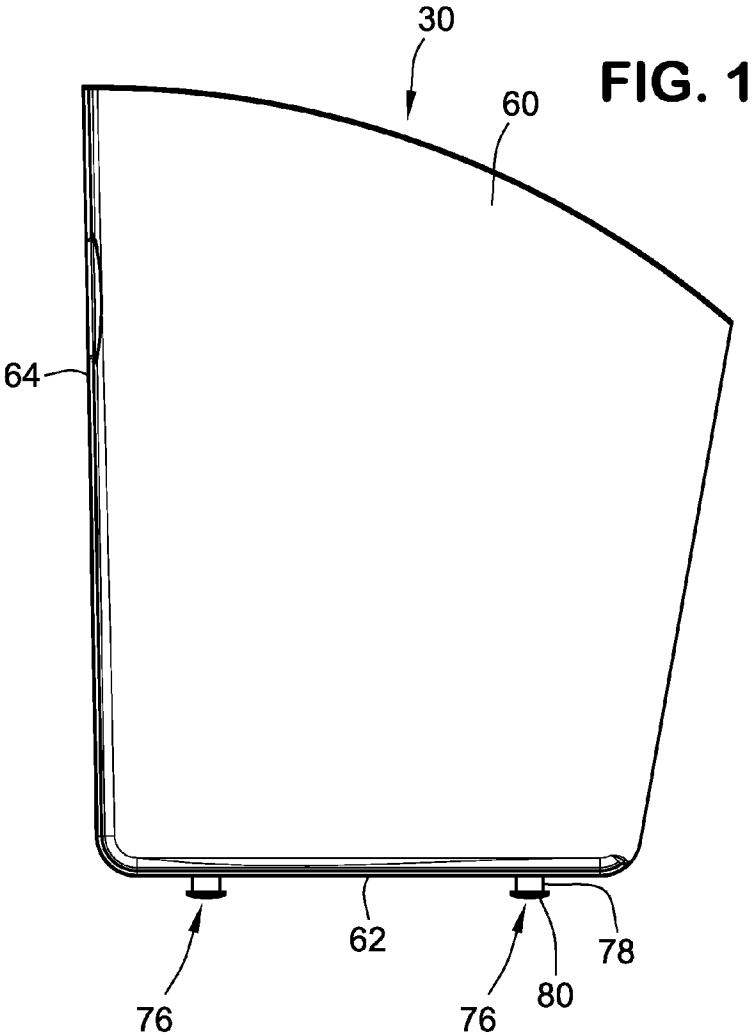
Figure 9:
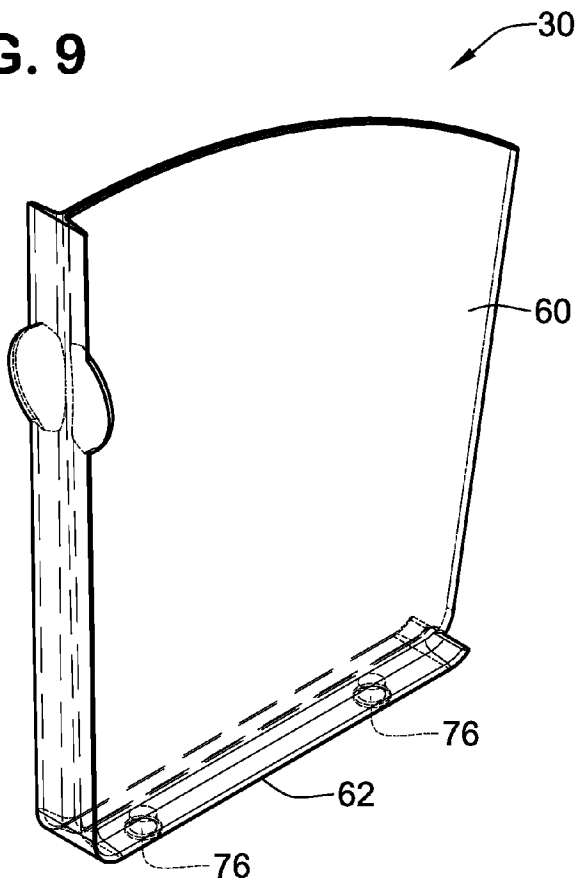

FIGS. 7 and 8 are similar views to FIGS. 5 and 6 except illustrating use with a cross bar instead of a wire rack;

FIGS. 9 and 10 are isometric and side views of a partition for use in dividing the bin into separate compartments (as shown, for example, in FIG. 1); and While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
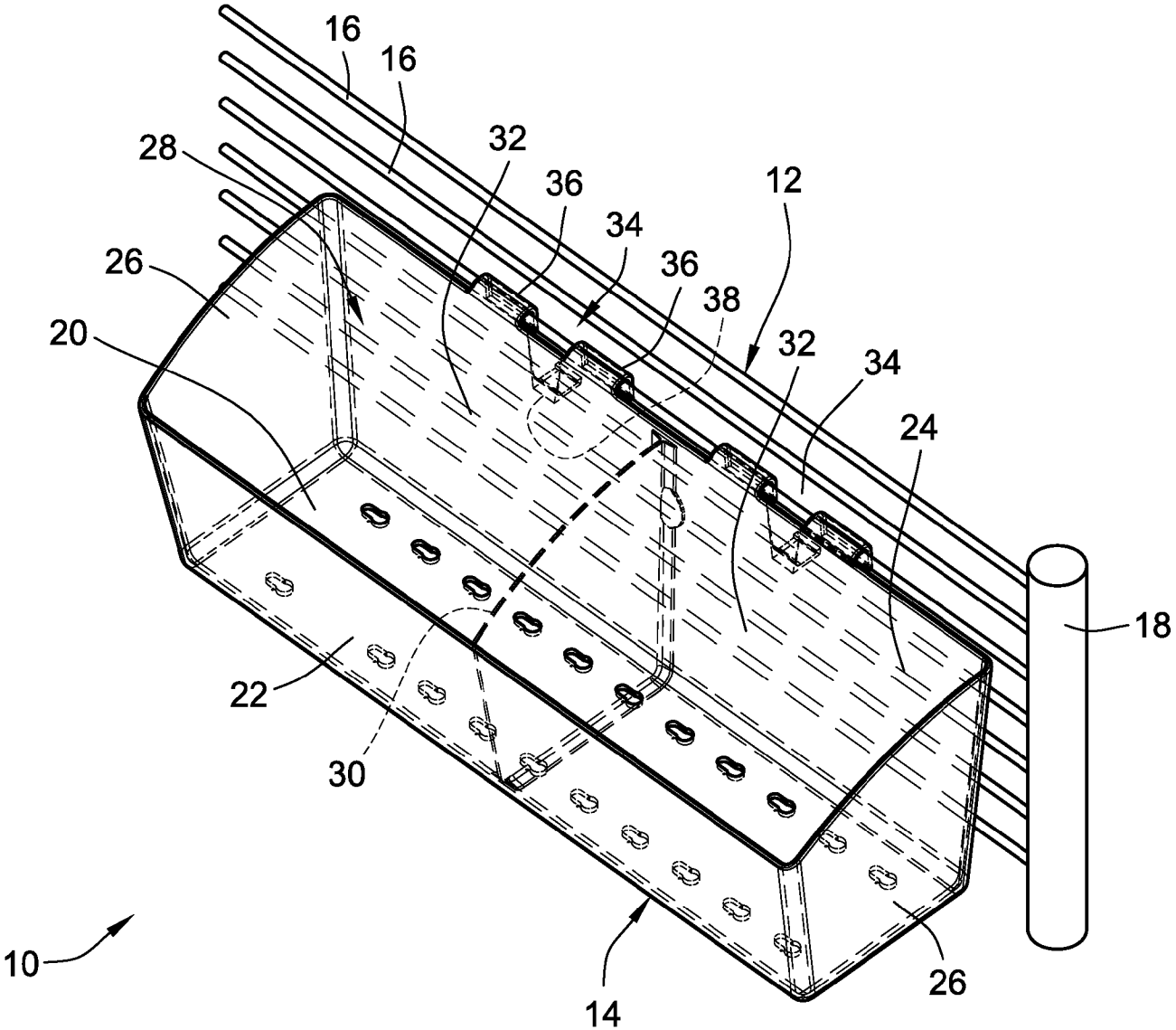
FIG. 1 is an isometric illustration of an apparatus for displaying merchandise comprising a receptacle, which is shown in combination with a suitable retail support illustrated as a portion of a wire rack.
Figure 2:
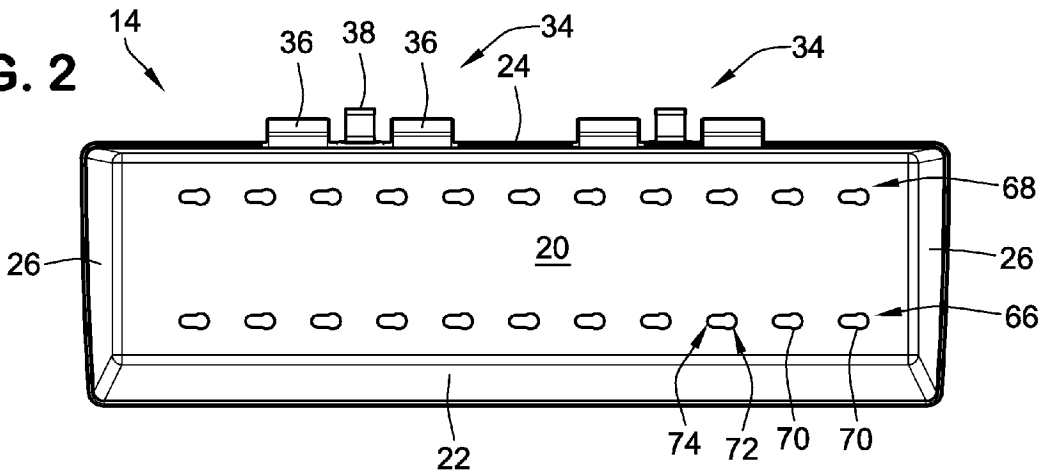
FIG. 2 is a top view of the receptacle illustrated in FIG. 1.
Figure 3:
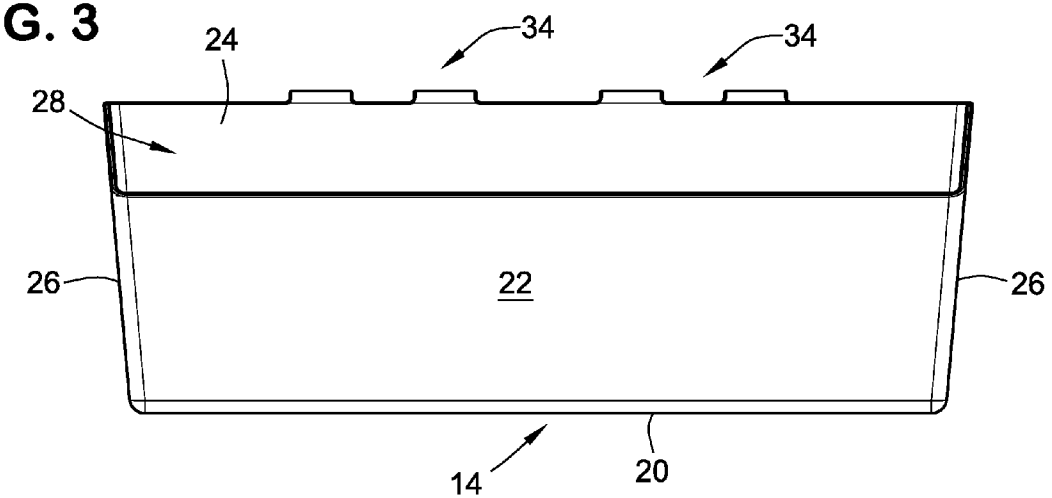
FIG. 3 is a front end view of the receptacle shown in FIG. 2.

Referring to FIG. 1, an embodiment of the present invention has been illustrated as a retail display system 10 for displaying various types of retail merchandise. The retail display system in FIG. 1 is shown as in using a wire rack 12 and/or receptacle in the form of a bin 14 mounted to the wire rack 12. The wire rack 12 includes a plurality of horizontally extending and vertically spaced wires 16, the ends of which can be mounted or otherwise supported by vertical posts 18. Such wire racks, according to one embodiment, may include wires having a diameter of about 3/16th of an inch and a vertical spacing of about 1 inch, and there are various commercial examples such as the FAST RACK® product of Southern Imperial, embodying such wire racks.

The bin 14 is preferably an opaque or transparent unitarily formed plastic molded member that may be formed from a 1-pull mold with a single part line (i.e. 2 mold haves only), thereby preventing the need for specialized mold tooling and/or removable cores. The bin includes a bottom 20, a front wall 22, a back wall 24, and a pair of side walls 26. The various walls 22, 24, 26 extend upward from the bottom 20 with the side walls in lateral spaced relation traversing between front and back walls 22, 24 so as to define a merchandise chamber 28 for holding retail merchandise. The merchandise chamber 28 may be broken up by an optional divider partition 30 into two or more individual merchandise compartments 32.

As shown, preferably the back wall 24 is substantially vertically oriented while the side walls 26 and the front wall 22 cannot move slightly outwardly as the walls project upwardly.

The bin 14 further includes one or more universal mounts and in this case two universal mounts 34 along the back wall 24 of the receptacle. Each universal mount 34 includes one or more hooks and in this case two hooks 36 and one or more retainers and in this case a single retainer 38. As shown, the retainer 38 is at least partially and preferably completely horizontally offset from the hooks and preferably sandwiched between the pair of hooks 36 for each universal mount 34. Preferably more hooks 36 than retainers are provided as the hooks 36 generally carry the load and weight holding capacity of the receptacle wall, while the retainer 38 is provided to prevent accidental dislodgment of the overall receptacle. Preferably each hook and retainer is unitarily molded with the receptacle with at least two sets of hooks and retainer spaced laterally apart and shown as two universal mounts 34.

As shown in FIG. 1, each hook 36 is configured to hook upon a selected one of the cross wires 16. However, the hooks 36 are also adapted to engage and receive cross bars 58 as shown and discussed later with reference to FIGS. 7 and 8. Accordingly, this feature provides a universal mounting feature for two different types of retail support structures, and in this case wire racks and retail cross wires. Each hook generally includes a rearwardly extending spacer portion integral with the back wall 24 in a downward portion 42 extending downwardly from the spacer portion. This defines a slot 44 which is adapted to receive either of a cross bar or a rack wire.

Each retainer 38 preferably includes a bottom flange 46 projecting integrally and rearwardly from the back wall 24 in vertical spaced relation to its corresponding hook 36 so as to provide a free opening space which appears from the side view as a mounting channel 48 into which area can be received one or more cross wires and/or one or more cross bars. Preferably an upwardly depending flange 50 projects from the back end of the bottom flange 46 so as to provide a snap-on feature or other structure that helps prevent accidental removal of the bin 14 from its retail support structure.

For typical retail applications, the retainers can be spaced from the hook by an internal vertical span each of between about 1 inch and about 1.25 inches; the hooks 36 will define a slot with W between about 0.15 and about 0.35 inches. In this manner, the dimensions H and W are configured to accommodate at least one of the retail buyer racks with about a 1 inch spacing between adjacent wires and about a 3/16th inch wire diameter; or a cross bar having a vertical span of about 1 inch and a thickness of about 3/16th inch. Additionally, the upwardly depending flange 50 may project vertically upward from the bottom flange 46 a distance of less than about 0.25 inches. While the bin has been illustrated, it is readily appreciated that a shallower or deeper depth might be provided while still being sufficient for retail applications. Typically, in such applications the back wall will extend higher than the front wall relative to the bottom with the back wall extending between about 2-8 inches; the front wall extending between about 0.5-5 inches; the bottom spacing, the front and back walls by between about 2-6 inches and spacing the side walls by between about 10-40 inches.

Figure 4:
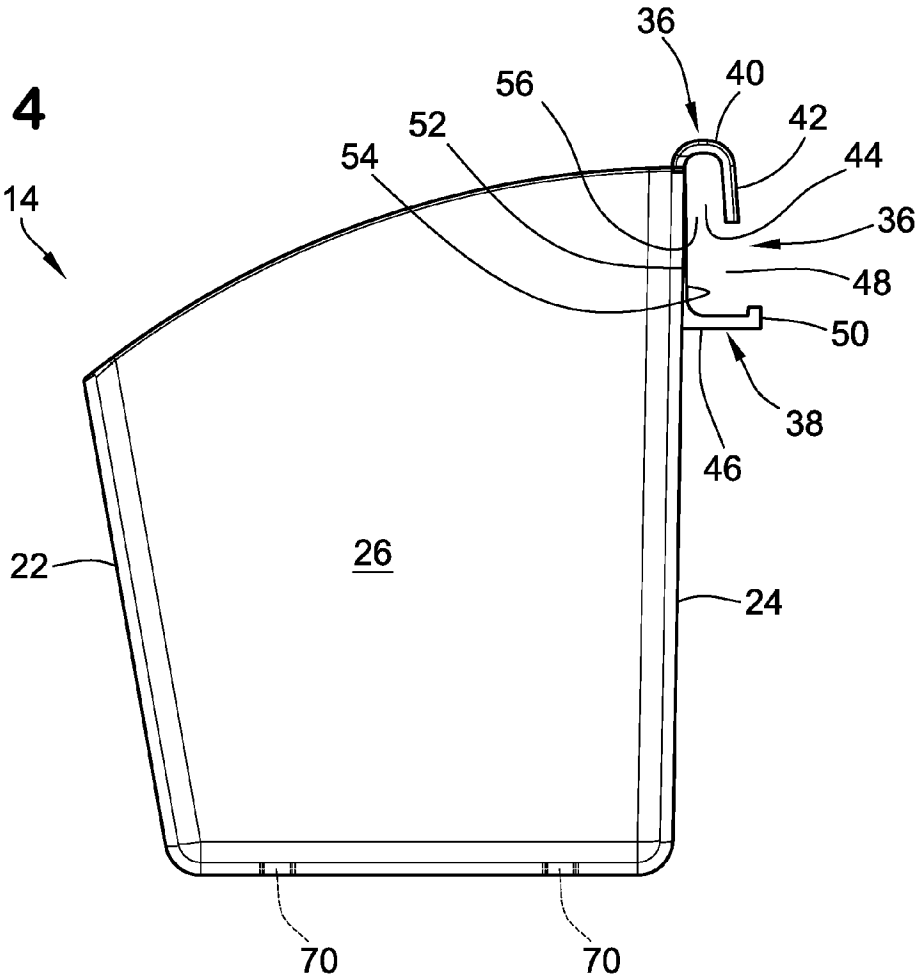
FIG. 4 is a side end view of the receptacle shown in previous figures.

Another feature that may be provided is a ramp feature along the back wall 24 as shown best for example in FIGS. 4-6. The ramp feature includes a ramp 52 which vertically aligns and connects with each retainer 36. Each ramp 52 includes a ramp surface that extends at an inclined angle relative to the extension of the back wall. The ramp surface 54 can help keep the bin 14 substantially upward when in the mounted position. Specifically, the bin 14 can be loaded fairly heavily which may cause the front end of the bin to want to droop a bit. The ramp 52 tends to counteract this by ever so slightly spacing the back wall 24 off of the wires 16 that are below the hooks 36. For example, the ramp 52 may have an effective inclined angle of between about 2 degrees and about 10 degrees relative to the extension of the back wall. Additionally, the downward portion 42 of each hook 36 is slanted slightly rearwardly away from the back wall 24 as it projects downwardly which provides a slightly larger entrance region 56 to facilitate easier insertion of cross wires or cross bars. The downward portion 42 may also extend at an angle relative to the extension of the back wall 24 of between about 2 degrees and about 10 degrees.

When the bin 14 is used in combination with a wire rack the universal mount 34 can be manipulated onto the cross wires as illustrated in FIGS. 5 and 6. As shown in FIG. 5, the receptacle first has an install position in which the individual hooks 36 are put onto an upper wire of the wires 16 and in a pivoted position in which the bin 14 is tilted relative to the wire rack with the retainers spaced in front of the wires 16. Once hooked, the bin 14 can then be pivoted into the mounted position shown in FIG. 6 where the retainer is slid underneath and in close proximity (closely spaced or engagement as shown) to one of the wires for preventing vertical removal of the receptacle from the wire rack. During this action, the resiliency afforded either in the wires and/or the plastic material of the bin allows the retainer 38 to resiliently flex and snap out of the way to provide clearance to facilitate the full pivoting movement into the mounted position.

Additionally, the bin 14 may alternatively be used with a retail cross bar 58 as shown in cross section in FIGS. 7 and 8 which also show and install in mounted positions similar to FIGS. 5 and 6 except it utilizes a cross bar as opposed to cross wires. As shown in FIG. 7, the top end of the cross bar 58 is first slid into the entrance 56 of the slot 44 which is facilitated in part by providing a wider entrance region for the slot 44. In this position, the retainers 38 may be disposed along the front face of the cross bar 58 and may engage or about engage the front surface of the cross bar 58. To facilitate the movement to the mounted position, the bin 14 is rotated from the tilted position shown in FIG. 7 to the vertical position shown in FIG. 8. During this pivoting movement, the hooks and the retainers can resiliently flex outward relative to each other to widen the overall entrance region therebetween to provide sufficient clearance for facilitating the pivoting movement and allow the cross bar 58 to enter fully into the mounting channel 48.

An additional feature which may be provided is a means for dividing the receptacle such as a partition and means for mounting the dividing means to the receptacle such as fastener structures. In the preferred embodiment, and as shown with reference to FIGS. 1, 9 and 10, each divider partition 30 may comprise a divider wall 60 having a base end provided by a bottom flange 62 and front and back ends that are adapted to meet with the front and back walls 22, 24 of the bin. In this instance, a back end flange 64 provides for the back end while the front end is simply provided by a terminating end of the divider wall 60. As shown in FIG. 10, the general shape of the overall divider wall 60 generally takes the shape of the cross section through the corresponding bin 14 so as to fully divide different merchandise compartments 32.

To provide for mounting of the divider wall 60, the bottom 20 of the bin 14 includes first and second rows 66, 68 of apertures 70 formed through the bottom 20 of the bin 14. Each aperture 70 has an enlarged entry region 72 and a narrower slot region 74. The divider wall 60 includes a structure to fasten with the apertures 70 in the form of two locking tabs 76. The locking tabs 76 include a narrow neck region and an enlarged head 80 on the end of the neck such that the neck 78 generally spaces the head 80 from the base end of the divider wall. As shown, the locking tabs 76 can be formed integrally along the bottom flange 62. To facilitate assembly of the divider wall when used and/or disassembly, the heads 80 of the locking tabs 76 can be inserted through selected apertures 70 then the entire dividing wall can be slid horizontally so as to slide the neck region 78 into the slot region 74. Once in this position, the partition cannot be vertically removed as the head 80 of each slot of the locking tabs 76 is larger than the narrow slot region 74 of the aperture 70. As providing the bottom flange 62, more secure attachment and removal prevention is facilitated, as well as overall structural integrity of the partitioned divider.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An apparatus for displaying retail merchandise, comprising:

a receptacle having a bottom, a front wall, a back wall and a pair of side walls, the walls extending upward from the bottom to define a chamber for holding retail merchandise;

at least one hook projecting from the back wall;

at least one removable divider positioned within the receptacle and in contact with the bottom, the front wall, and the back wall to separate the chamber into discrete side by side retail merchandise containment compartments;

at least one retainer projecting from the back wall in vertically spaced relation to the at least one hook;

wherein the at least one retainer is at least partially horizontally offset from the at least one hook;

wherein each retainer is sandwiched between two hooks, one on each lateral side of the retainer;

wherein each hook and each retainer are unitarily formed with the receptacle, the hook including a spacer portion extending rearwardly from the back wall and a downward portion depending downwardly from the spacer portion to define a slot in conjunction with the spacer portion and the back wall;

wherein the at least one retainer is below the at least one hook and defines an internal vertical span H therebetween of between about 1 inch and about 1.25 inches, wherein the slot defines an internal width W of between about 0.15 and about 0.35 inches, whereby the dimensions H and W are configured to accommodate at least one of a retail wire rack with about a 1 inch spacing between adjacent wires of about 3/16 inch diameter and a retail cross bar having a vertical span of about a 1 inch and a thickness of about 3/16 inch;

wherein the at least one retainer includes a bottom flange projecting rearwardly from the back wall and an upwardly depending flange projecting from the bottom flange in spaced relation to the back wall; and further comprising a ramp along the back wall defining a ramp surface at a first inclined angle relative to an extension of the back wall, and wherein the downward portion projects away from the extension of the back wall at a second inclined angle relative thereto, wherein the first and second inclined angles are between 2 degrees and 10 degrees.

2. The apparatus of claim 1, wherein each hook and each retainer are unitarily molded with the receptacle, the receptacle being formed of plastic material, further comprising at least two sets of hooks and retainers spaced laterally apart.

3. The apparatus of claim 1, wherein the upwardly depending flange is arranged and configured with a height of less than about 0.25 inches to provide means for resilient snap-on connection of the receptacle to a retail support structure.

4. The apparatus of claim 1, wherein the back wall extends higher than the front wall relative to the bottom, the back wall extending between about 2 and about 8 inches, and wherein the front wall extends between about 0.5 and about 5 inches, the bottom spacing the front and back walls by between about 2 and about 6 inches and wherein the bottom spaces the side walls by between about 10 and about 40 inches.

5. The apparatus of claim 1, further comprising a wire rack in combination, the wire rack including a plurality, of horizontally extending wires in generally parallel and vertically spaced relation, wherein the receptacle has an install position tilted relative to the wire rack with the at least one hook mounted on one of the wires and the at least one retainer spaced in front of the wires, and a mounted position pivoted relative to the install position, with the at least one retainer disposed underneath in close proximity to one of the wires for preventing vertical removal of the receptacle from the wire rack.

6. The apparatus of claim 1, further comprising at least one retail cross bar in combination, wherein the receptacle has an installed position with a top portion of the cross bar received just into an entrance region of the at least one hook and a bottom portion of the cross bar abutting the at least one retainer along a front surface of the cross bar, and a mounted position pivoted relative to the installed position, the at least one hook and the at least one retainer resiliently flexing outward relative to each during movement between the installed and the mounted position to provide clearance to facilitate pivoting movement.

7. The apparatus of claim 1, wherein the at least one hook has a distal end and the at least one retainer has a distal end, the distal end of the at least one retainer spaced farther away from the receptacle than the distal end of the at least one hook.

* * * * *